US011776459B2

(12) United States Patent
Chen

(10) Patent No.: US 11,776,459 B2
(45) Date of Patent: Oct. 3, 2023

(54) DISPLAY DEVICE AND TERMINAL HAVING AN ENERGY SAVING MODE WITH DATA COMPENSATION

(71) Applicant: Shenzhen China Star Optoelectronics Semiconductor Display Technology Co., Ltd., Shenzhen (CN)

(72) Inventor: Haiping Chen, Shenzhen (CN)

(73) Assignee: Shenzhen China Star Optoelectronics Semiconductor Display Technology Co., Ltd., Shenzhen (CN)

( * ) Notice: Subject to any disclaimer, the term of this patent is extended or adjusted under 35 U.S.C. 154(b) by 0 days.

(21) Appl. No.: 16/765,904

(22) PCT Filed: Apr. 21, 2020

(86) PCT No.: PCT/CN2020/085908
§ 371 (c)(1),
(2) Date: May 21, 2020

(87) PCT Pub. No.: WO2021/203477
PCT Pub. Date: Oct. 14, 2021

(65) Prior Publication Data

US 2023/0029708 A1 Feb. 2, 2023

(30) Foreign Application Priority Data

Apr. 9, 2020 (CN) ..... 202010272455.4

(51) Int. Cl.
*G09G 3/32* (2016.01)

(52) U.S. Cl.
CPC ..... *G09G 3/32* (2013.01); *G09G 2300/0426* (2013.01); *G09G 2300/0452* (2013.01); *G09G 2300/0842* (2013.01); *G09G 2330/021* (2013.01)

(58) Field of Classification Search
CPC ..... G09G 3/32
USPC ..... 345/55
See application file for complete search history.

(56) References Cited

U.S. PATENT DOCUMENTS

| | | | | |
|---|---|---|---|---|
| 2008/0150846 | A1 | 6/2008 | Chung | |
| 2010/0277463 | A1* | 11/2010 | Yen et al. | G09G 3/20 345/99 |
| 2013/0181969 | A1 | 7/2013 | Kishi | |
| 2014/0176525 | A1 | 6/2014 | Woo et al. | |
| 2014/0225938 | A1 | 8/2014 | Soni et al. | |

(Continued)

FOREIGN PATENT DOCUMENTS

| | | | |
|---|---|---|---|
| CN | 101051446 | A | 10/2007 |
| CN | 101231821 | A | 7/2008 |
| CN | 103168324 | A | 6/2013 |
| CN | 103886831 | A | 6/2014 |
| CN | 104680982 | A | 6/2015 |

(Continued)

*Primary Examiner* — Long D Pham
(74) *Attorney, Agent, or Firm* — Nathan & Associates; Menachem Nathan

(57) ABSTRACT

A display device and a terminal are provided. The display device includes first pixel units and second pixel units arranged alternately along a first direction. In an energy saving mode, a control module is used for controlling one of the first pixel units and the second pixel units to emit light in a current display frame, for controlling another one to detect a threshold voltage of driving units of pixel driving circuits, and for controlling pixel units emitting light and pixel units for detecting to swap with each other. Energy consumption can be lowered, and detection time is sufficient.

20 Claims, 8 Drawing Sheets

(56) References Cited

U.S. PATENT DOCUMENTS

| | | | | |
|---|---|---|---|---|
| 2015/0179105 | A1 | 6/2015 | Mizukoshi | |
| 2016/0037156 | A1 | 2/2016 | Lee | |
| 2016/0189614 | A1 | 6/2016 | Tani et al. | |
| 2017/0294163 | A1 | 10/2017 | Wu et al. | |
| 2018/0025690 | A1* | 1/2018 | Bao et al. ..... | G09G 3/3258 345/691 |
| 2018/0350303 | A1 | 12/2018 | Jin | |

FOREIGN PATENT DOCUMENTS

| | | | |
|---|---|---|---|
| CN | 104732920 | A | 6/2015 |
| CN | 105702206 | A | 6/2016 |
| CN | 105741784 | A | 7/2016 |
| CN | 107093402 | A | 8/2017 |
| CN | 110189704 | A | 8/2019 |
| CN | 110956929 | A | 4/2020 |

* cited by examiner

DISPLAY DEVICE AND TERMINAL HAVING AN ENERGY SAVING MODE WITH DATA COMPENSATION

FIELD OF INVENTION

The present disclosure relates to the field of display technology, and particularly relates to a display device and a terminal.

BACKGROUND OF INVENTION

In current display devices, each pixel is driven to emit light by pixel driving circuits. A threshold voltage (Vth) of driving transistors in the pixel driving circuits can drift due to various reasons. Therefore, the Vth of driving transistors needs to be detected and compensated to improve evenness of panels. A compensation method in the prior art is performing detection during a blank time between adjacent display frames and then performing data compensation in a next display frame. However, detection requires a long time, and duration of the blank time period is limited. Particularly, in a situation of a high refresh rate and large dimensions, the detection time is short, and the detection cannot be performed immediately, resulting in follow-up compensation effect being poor and difficulty in improving evenness of the panels.

Therefore, the technical problem of poor threshold voltage compensation effect in the current display devices needs to improve.

SUMMARY OF INVENTION

Embodiments of the present disclosure provide a display device and a terminal to ease the technical problem of poor threshold voltage compensation effect in the current display devices.

In order to solve the problems mentioned above, the present disclosure provides the technical solutions as follows:

An embodiment of the present disclosure provides a display device, including:

a plurality of subpixels, wherein the plurality of subpixels are disposed in an array arrangement in the display device to form a plurality of pixel units, the plurality of pixel units include a plurality of first pixel units and a plurality of second pixel units arranged alternately along a first direction, and the plurality of first pixel units and the plurality of second pixel units include at least one row of the plurality of subpixels;

a plurality of pixel driving circuits used for driving the plurality of subpixels to emit light by a plurality of driving units, wherein the plurality of pixel driving circuits include a first pixel driving circuit driving the plurality of subpixels in the plurality of first pixel units to emit light by a first driving unit, and a second pixel driving circuit driving the plurality of subpixels in the plurality of second pixel units to emit light by a second driving unit; and a control module used for controlling the display device to enter an energy saving mode according to obtained control parameters, wherein in the energy saving mode, the control module is used for controlling the first pixel driving circuit to drive the plurality of subpixels in the plurality of first pixel units to emit light in odd display frames by the first driving unit, for detecting a first threshold voltage of the first driving unit in even display frames, for performing data compensation on the first driving unit according to the detected first threshold voltage in a next odd display frame, for controlling the second pixel driving circuit to drive the plurality of subpixels in the plurality of second pixel units to emit light in the even display frames by the second driving unit, for detecting a second threshold voltage of the second driving unit in the odd display frames, and for performing a data compensation on the second driving unit according to the detected second threshold voltage in a next even display frame.

In the display device of the present disclosure, the control module is used for controlling the display device to enter the energy saving mode according to obtained data of a current displayed image being in a static state or characters.

In the display device of the present disclosure, the control module is used for controlling the display device to enter the energy saving mode according to an instruction for entering the energy saving mode obtained from external input.

in the display device of the present disclosure, the plurality of pixel driving circuits include a data signal input unit, the driving units, a detection unit, and a storage unit. The data signal input unit is used for inputting a first data signal to a first node under control of a first control signal. The driving units are used for driving a light emitting device corresponding to the plurality of subpixels to emit light under electric potential control of the first node. The detection unit is connected to the driving units through a second node and is used for detecting a threshold voltage of the driving units under control of a second control signal. The storage unit is connected to the driving units through the first node and the second node and is used for storing the threshold voltage of the driving units. The data signal input unit is further used for inputting a compensated second data signal to the first node according to the threshold voltage detected by the detection unit.

In the display device of the present disclosure, the data signal input unit includes a first transistor, wherein a gate electrode the first transistor is input the first control signal, a first electrode of the first transistor is connected to a data line, and a second electrode of the first transistor is connected to the first node.

In the display device of the present disclosure, the driving unit includes a second transistor, wherein a gate electrode of the second transistor is connected to the first node, a first electrode of the second electrode is input a power source high electric potential signal, and a second electrode of the second transistor is connected to the light emitting device through the second node.

In the display device of the present disclosure, the detection unit includes a third transistor, a first switch, and a second switch, wherein a gate electrode of the third transistor is input the second control signal, a first electrode of the third transistor is connected to the second node, a second electrode of the third transistor is connected to a first moving contact of the first switch and a second moving contact of the second switch, a first static contact of the first switch is connected to an initial voltage signal input terminal, and a second static contact of the second switch is connected to an analog-to-digital converter.

In the display device of the present disclosure, the storage unit includes a storage capacitor, wherein a first polar plate of the storage capacitor is connected to the first node, and a second polar plate of the storage capacitor is connected to the second node.

In the display device of the present disclosure, an anode of the light emitting device is connected to the second node, and a cathode of the light emitting device is input a power source low electric potential signal.

In the display device of the present disclosure, the light emitting device is micro light emitting diodes.

In the display device of the present disclosure, in the energy saving mode, during an initial stage of the detection time period, the detection unit is used for controlling the first moving contact to connect to the first static contact and for controlling the second moving contact to disconnect from the second static contact, during a charging stage of the detection time period, the detection unit is used for controlling the first moving contact and the first static contact and for controlling the second moving contact and the second static contact to disconnect from each other, and during a voltage detection stage of the detection time period, the detection unit is used for controlling the first moving contact to disconnect from the first static contact and for controlling the second moving contact to connect to the second static contact.

In the display device of the present disclosure, in a same display frame of the energy saving mode, the control module is used for controlling the plurality of pixel driving circuits required to detect a threshold voltage to be inputted the first data signal in a same time and is used for controlling the plurality of pixel driving circuits required to drive the plurality of subpixels to emit light to be inputted the second data signal row by row along the first direction, wherein a time of inputting the first data signal does not overlap with the time of inputting the second data signal.

In the display device of the present disclosure, in a same display frame of the energy saving mode, the control module is used for controlling the pixel driving circuits required to detect a threshold voltage to be inputted the first data signal row by row along the first direction and is used for controlling the pixel driving circuits required to drive the plurality of subpixels to emit light to be inputted the second data signal row by row along the first direction, wherein a time of inputting the first data signal does not overlap with a time of inputting the second data signal. In the display device of the present disclosure, when the display device does not enter the energy saving mode, the control module is further used for controlling all the pixel driving circuits to drive corresponding subpixels to emit light in display frames and for detecting threshold voltages of the plurality of driving units in a blank time between adjacent display frames.

The present disclosure further provides a terminal including a display device and a housing. The display device includes:

a plurality of subpixels, wherein the plurality of subpixels are disposed in an array arrangement in the display device to form a plurality of pixel units, the plurality of pixel units include a plurality of first pixel units and a plurality of second pixel units arranged alternately along a first direction, and the plurality of first pixel units and the plurality of second pixel units include at least one row of the plurality of subpixels;

a plurality of pixel driving circuits used for driving the plurality of subpixels to emit light by a plurality of driving units, wherein the plurality of pixel driving circuits include a first pixel driving circuit driving the plurality of subpixels in the plurality of first pixel units to emit light by a first driving unit, and a second pixel driving circuit driving the plurality of subpixels in the plurality of second pixel units to emit light by a second driving unit; and a control module used for controlling the display device to enter an energy saving mode according to obtained control parameters, wherein in the energy saving mode, the control module is used for controlling the first pixel driving circuit to drive the plurality of subpixels in the plurality of first pixel units to emit light in odd display frames by the first driving unit, for detecting the a first threshold voltage of the first driving unit in even display frames, for performing data compensation on the first driving unit according to the detected first threshold voltage in a next odd display frame, for controlling the second pixel driving circuit to drive the plurality of subpixels in the plurality of second pixel units to emit light in the even display frames by the second driving unit, for detecting a second threshold voltage of the second driving unit in the odd display frames, and for performing data compensation on the second driving unit according to the detected second threshold voltage in a next even display frame.

In the terminal of the present disclosure, the control module is used for controlling the display device to enter the energy saving mode according to obtained data of a current displayed image being a static state or characters.

In the terminal of the present disclosure, the control module is used for controlling the display device to enter the energy saving mode according to an instruction for entering the energy saving mode obtained from external input.

In the terminal of the present disclosure, the plurality of pixel driving circuits include a data signal input unit, the driving units, a detection unit, and a storage unit. The data signal input unit is used for inputting a first data signal to a first node under control of a first control signal during a detection time period, the driving units are used for driving a light emitting device corresponding to the plurality of subpixels to emit light under electric potential control of the first node during a display time period. The detection unit is connected to the driving units through a second node and is used for detecting a threshold voltage of the driving units under control of a second control signal during the detection time period. The storage unit is connected to the driving units through the first node and the second node and is used for storing the threshold voltage of the driving units. The data signal input unit is used for inputting a compensated second data signal to the first node according to a threshold voltage detected by the detection unit during a next display time period.

In the terminal of the present disclosure, in a same display frame of the energy saving mode, the control module is used for controlling the plurality of pixel driving circuits required to detect a threshold voltage to be inputted the first data signal in a same time and is used for controlling the plurality of pixel driving circuits required to drive the plurality of subpixels to emit light to be inputted the second data signal row by row along the first direction, wherein the time of inputting the first data signal does not overlap with the time of inputting the second data signal.

In the terminal of the present disclosure, in a same display frame of the energy saving mode, the control module is used for controlling the pixel driving circuit required to detect a threshold voltage to be inputted the first data signal row by row along the first direction and is used for controlling the pixel driving circuit required to drive the plurality of subpixels to emit light to be inputted the second data signal row by row along the first direction, wherein a time of inputting the first data signal does not overlap with the time of inputting the second data signal.

Beneficial effects of the present disclosure: embodiments of the present disclosure provide a display device and a terminal; the display device includes a plurality of subpixels, a plurality of pixel driving circuits, and a control module; the plurality of subpixels are disposed in an array arrangement in the display device to form a plurality of pixel units, the plurality of pixel units includes a plurality of first pixel units and a plurality of second pixel units arranged alternately along a first direction, and the plurality of first pixel units and the plurality of second pixel units include at least one row of the plurality of subpixels; the plurality of pixel driving circuits is used for driving the plurality of subpixels to emit light by a plurality of driving units, and the plurality of pixel driving circuits include a first pixel driving circuit driving the plurality of subpixels in the plurality of first pixel units to emit light by a first driving unit, and a second pixel driving circuit driving the plurality of subpixels in the plurality of second pixel units to emit light by a second driving unit; and the control module is used for controlling the display device to enter an energy saving mode according to obtained control parameters, in the energy saving mode, the control module is used for controlling the first pixel driving circuit to drive the plurality of subpixels in the plurality of first pixel units to emit light in odd display frames by the first driving unit, for detecting the a first threshold voltage of the first driving unit in even display frames, for performing data compensation on the first driving unit according to the detected first threshold voltage in a next odd display frame, for controlling the second pixel driving circuit to drive the plurality of subpixels in the plurality of second pixel units to emit light in the even display frames by the second driving unit, for detecting a second threshold voltage of the second driving unit in the odd display frames, and for performing data compensation on the second driving unit according to the detected second threshold voltage in a next even display frame. The display device of the present disclosure enters the energy saving mode under a certain condition, controls part of the subpixels to emit light in the energy saving mode and controls another part of the subpixels to perform threshold voltage detection corresponding the pixel driving circuit. Because duration of display frames is greater than a blank time period between the adjacent display frames, energy consumption is made to be low, meanwhile the detection time is also sufficient, and detection can be performed immediately, subsequent compensation effect is good, and evenness of the panel is improved.

DESCRIPTION OF DRAWINGS

To more clearly illustrate embodiments or the technical solutions of the present disclosure, the accompanying figures of the present disclosure required for illustrating embodiments or the technical solutions of the present disclosure will be described in brief. Obviously, the accompanying figures described below are only part of the embodiments of the present disclosure, from which those skilled in the art can derive further without making any inventive efforts.

DETAILED DESCRIPTION OF PREFERRED EMBODIMENTS

The descriptions of embodiments below refer to accompanying drawings in order to illustrate certain embodiments which the present disclosure can implement. The directional terms of which the present disclosure mentions, for example, "top," "bottom," "upper," "lower," "front," "rear," "left," "right," "inside," "outside," "side," etc., are just refer to directions of the accompanying figures. Therefore, the used directional terms are for illustrating and understanding the present disclosure, but not for limiting the present disclosure. In the figures, units with similar structures are used same labels to indicate.

An embodiment of the present disclosure provides a display device, which includes a plurality of subpixels, a plurality of pixel driving circuits, and a control module. The plurality of subpixels are disposed in an array arrangement in the display device to form a plurality of pixel units. The plurality of pixel units include a plurality of first pixel units and a plurality of second pixel units arranged alternately along a first direction. The plurality of first pixel units and the plurality of second pixel units include at least one row of the plurality of subpixels. The pixel driving circuit is used for driving the plurality of subpixels to emit light by a plurality of driving units, and the plurality of pixel driving circuits include a first pixel driving circuit driving the plurality of subpixels in the plurality of first pixel units to emit light by a first driving unit, and a second pixel driving circuit driving the plurality of subpixels in the plurality of second pixel units to emit light by a second driving unit. The control module is used for controlling the display device to enter an energy saving mode according to obtained control parameters. In the energy saving mode, the control module is used for controlling the first pixel driving circuit to drive the plurality of subpixels in the plurality of first pixel units to emit light in odd display frames by the first driving unit, for detecting a first threshold voltage of the first driving unit in even display frames, for performing data compensation on the first driving unit according to the detected first threshold voltage in a next odd display frame, for controlling the second pixel driving circuit to drive the plurality of subpixels in the plurality of second pixel units to emit light in the even display frames by the second driving unit, for detecting a second threshold voltage of the second driving unit in the odd display frames, and for performing data compensation on the second driving unit according to the detected second threshold voltage in a next even display frame.

Figure 1:
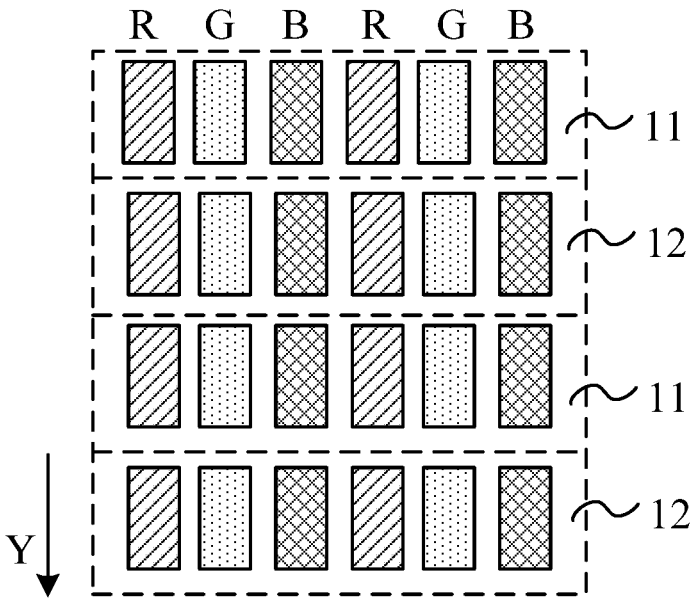
FIG. 1 is a first arrangement schematic diagram of pixel units in a display device provided by an embodiment of the present disclosure.

As illustrated in FIG. 1, the display device includes the plurality of subpixels disposed in the array arrangement. The subpixels include a red subpixel R, a green subpixel G, and a blue subpixel B. The red subpixel R, the green subpixel G, and the blue subpixel B form one pixel together. The plurality of subpixels form the plurality of pixel units. The plurality of pixel units include a plurality of first pixel units 11 and a plurality of second pixel units 12 arranged alternately along the first direction Y. The plurality of first pixel units 11 and the plurality of second pixel units 12 include at least one row of the plurality of subpixels. In an embodiment, the first direction Y is a direction of vertical columns. The first pixel units 11 include one row of the subpixels, and the second pixel units 12 include one row of the subpixels. Because both of the two are arranged along the first direction alternately, the subpixels in the first pixel units 11 are odd-row subpixels, and the subpixels in the second pixel units 12 are even-row subpixels. However, the present disclosure is not limited thereto, and positions of the first pixel units 11 and the second pixel units 12 can be exchanged. At this time, the subpixels in the first pixel units 11 are even-row subpixels, and the subpixels in the second pixel units 12 are odd-row subpixels.

Figure 2:
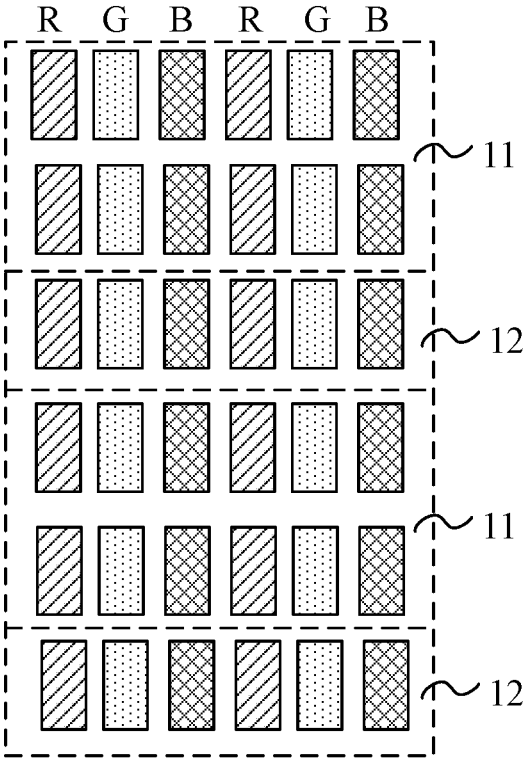
FIG. 2 is a second arrangement schematic diagram of the pixel units in the display device provided by an embodiment of the present disclosure.

In an embodiment, as illustrated in FIG. 2, two rows of the subpixels are disposed in the first pixel units 11, one row of subpixels are disposed in the second pixel units 12, and the first pixel units 11 and the second pixel units 12 are arranged alternately. That is, numbers of the rows of the subpixels in the first pixel units 11 and the second pixel units 12 can be more than one, and the numbers of the rows of the subpixels in the first pixel units 11 and the second pixel units 12 can be same or different. Those skilled in the art can dispose the numbers of the rows of the subpixels in each of the pixel units reasonably according to requirements. In order for ease of description, embodiments of the present disclosure are explained by taking the structure in FIG. 1 as an example.

Each of the subpixels in the display device are driven to emit light by the driving units of the pixel driving circuits, and each of the subpixels corresponds to one of the pixel driving circuits. The pixel driving circuits include a first pixel driving circuit and a second pixel driving circuit. The first pixel driving circuit drives the subpixels in the first pixel units to emit light by a first driving unit, and a second pixel driving circuit drives the subpixels in the plurality of second pixel units to emit light by a second driving unit.

The display device includes a display panel and a driving integrated circuit (IC) bound to the display panel. The subpixels and the pixel driving circuits are disposed in the display panel. The control module is disposed in the driving IC. The control module is used for controlling the display device to enter an energy saving mode according to obtained control parameters.

In the display device of the present disclosure, the light emitting device corresponding to the subpixels is micro light emitting diodes (micro LEDs). A dimension of a singular micro LED is small, which is about 1um to 100um. The micro LEDs constitute a display panel with a high resolution rate. Compared to other types of display panels, the display panel of the present disclosure include more pixels in a same dimension, so power consumption of large-sized panels is increased significantly. However, because pixels per inch (PPI) of the micro LEDs is greater, take a 4K panel as an example, if only half of the pixels are used to display, display effect can be made to be consistent with a general 2K liquid crystal panel. At this time, the resolution rate is decreased; however, a certain display panel can still be ensured. Therefore, in display scenarios that do not require high resolution rate, the control module can control the display device to enter energy saving mode after obtaining corresponding control parameters to make part of the subpixels emit light and another part of the subpixels to not emit light, so as to reduce power consumption of the display device.

Figure 3:
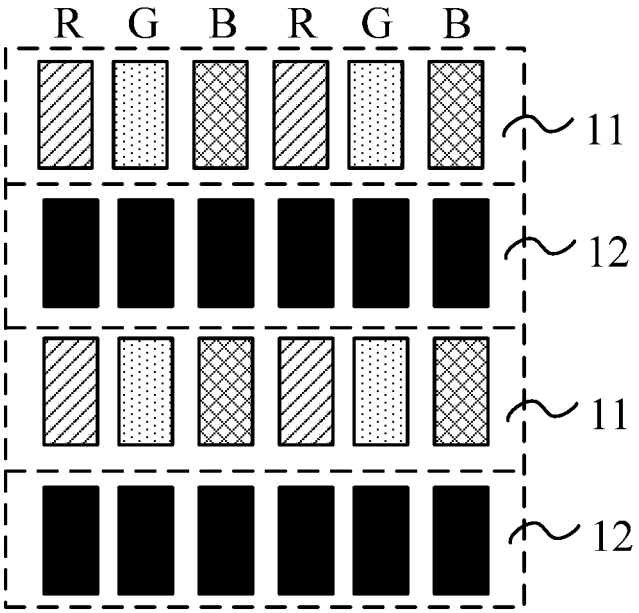
FIG. 3 is a schematic diagram of a light emitting situation of each of subpixels in the pixel units of FIG. 1 in odd display frames.
Figure 4:
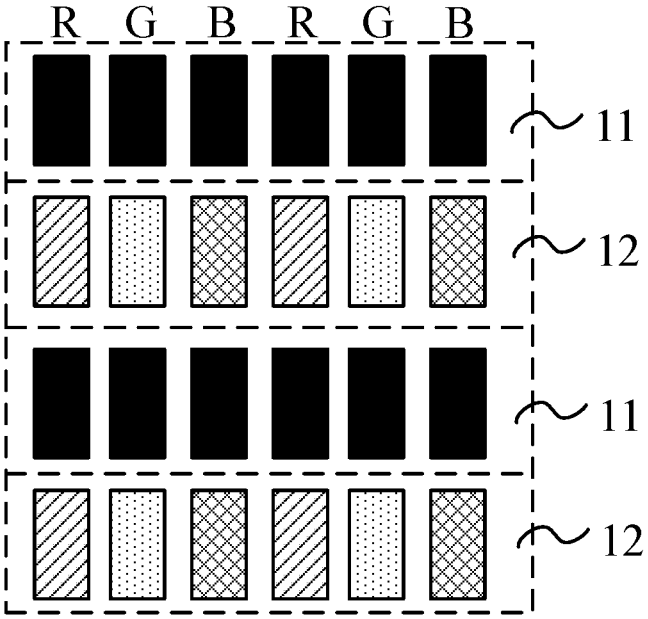
FIG. 4 is a schematic diagram of a light emitting situation of each of the subpixels in the pixel units of FIG. 1 in even display frames.

In the energy saving mode, in order to ensure a certain display effect, the subpixels emitting light and the subpixels not emitting light need to be arrange alternately, so that the maximum display effect can be ensured. Therefore, in the energy saving mode, the control module controls the first pixel units 11 and the second pixel units 12 of the display device to emit light alternately. Specifically, the first pixel driving circuits are controlled to drive the subpixels in the first pixel units 11 to emit light by the first driving unit in odd display frames, and the second pixel driving circuits are controlled to drive the subpixels in the second pixel units 12 to emit light by the second driving unit in even display frames. Hence, in the odd display frames, as illustrated in FIG. 3, the subpixels in the first pixel units 11 emit light, and the subpixels in the second pixel units 12 do not emit light. In the even display frames, as illustrated in FIG. 4, the subpixels in the first pixel units 11 do not emit light, and the subpixels in the second pixel units 12 emit light. Furthermore, from a first display frame in which the subpixels partially emit light to the end of the display frame in which the subpixels partially emit light last, this time period is the time period of the energy saving mode. All display frames in the time period are calculated from the first frame, every display frame arranged at odd numbers are the odd display frames, and every display frame arranged at even numbers are the even display frames.

The pixel driving circuit drives each of the subpixels to emit light by the driving units. After the pixel driving circuits work for a period of time, a drift phenomenon of the threshold voltage of the driving unit occurs. Therefore, the threshold voltage of the driving unit needs to be detected and data compensation is performed afterwards. In the energy saving mode, because the subpixels in the first pixel units 11 in the even display frames do not need to emit light, the control module can control the first pixel driving circuit to detect a first threshold voltage of the first driving unit in even display frames and to perform data compensation on the first driving unit according to the detected first threshold voltage in a next odd display frame. Meanwhile, because the subpixels in the second pixel units 12 in the odd display frames do not need to emit light, the control module can control the second pixel driving circuit to detect a second threshold voltage of the second driving unit in the odd display frames and to perform data compensation on the second driving unit according to the detected second threshold voltage in a next even display frame.

A compensation method in the prior art is performing detection during a blank time between adjacent display frames and then performing data compensation in a next display frame. However, detection requires a long time, and duration of the blank time period is limited. Particularly, in a situation of a high refresh rate and large dimensions, the detection time is short, and the detection cannot be performed immediately, resulting in subsequent compensation effect being poor and difficulty in improving evenness of the panels.

The display device of the present disclosure enters the energy saving mode under a certain condition, controls part of the subpixels to emit light in the energy saving mode and controls another part of the subpixels to perform threshold voltage detection corresponding the pixel driving circuit. Because duration of display frames is greater than a blank time period between the adjacent display frames, energy consumption is made to be low, and meanwhile the detection time is also sufficient, and detection can be performed immediately, subsequent compensation effect is good, and evenness of the panel is improved.

Figure 5:
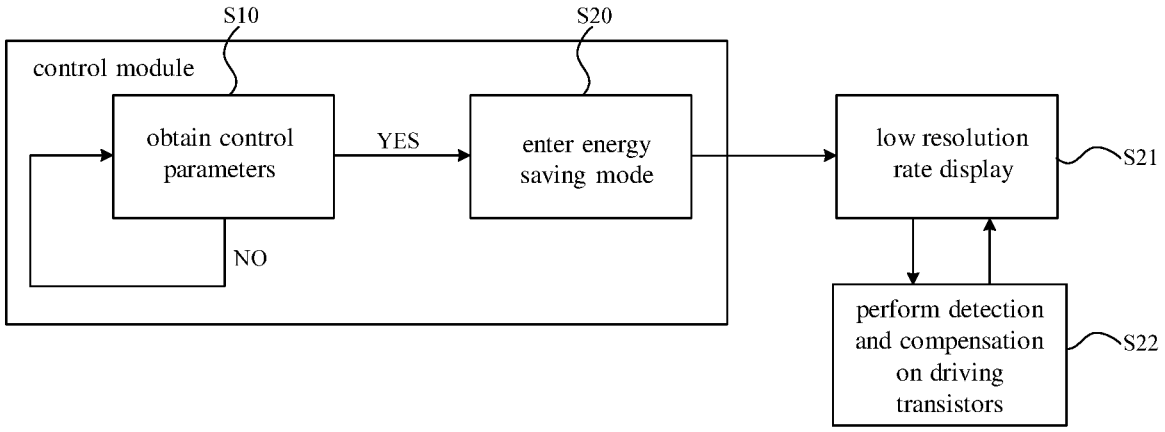
FIG. 5 is a schematic diagram of an implementation process of the display device provided by an embodiment of the present disclosure realizing reduction of energy consumption and detection.

An implementation process of the display device realizing reduction of energy consumption and detection is illustrated in FIG. 5 and includes following steps:

S10: obtaining control parameters. Firstly, the control module obtains the control parameters, and then judges whether to enter the energy saving mode according to the control parameters.

S20: entering the energy saving mode. When it is not necessary to enter the energy saving mode, the control module continues keeping a state of obtaining the control parameters according to the control parameters. When it is necessary to enter the energy saving mode, then the energy saving mode is entered. In the energy saving mode, the control module controls each of the pixel driving circuits to realize different functions to make each of the subpixels present two states.

S21: low resolution rate display. The control module controls the pixel driving circuits to drive part of the subpixels to emit light and part of the subpixels not to emit light in a current display frame, and the subpixels emitting light and the subpixels not emitting light are alternately arranged in units of one row or multi-rows to make the drive device enter the low resolution rate display state.

S22: performing detection and compensation on a driving transistor. The control module controls the pixel driving circuits of the subpixels not emitting light to perform the detection and the compensation on the threshold voltage of the driving transistor in the current display frame.

When swapping to a next display frame, the states of each of the subpixels in the S21 and S22 are exchanged. The subpixels emitting light originally are changed to not emit light, and the subpixels not emitting light originally are changed to emit light. Correspondingly, the detection and the compensation of the threshold voltage are performed on the driving transistors in the pixel driving circuits corresponding to the subpixels not emitting light.

By the steps mentioned above, the control module controls part of the subpixels to emit light and controls the pixel driving circuits corresponding to another part of the subpixels to perform the detection of the threshold voltage in the current display frame in the energy saving mode. Because duration of the display frames is greater than a blank time period between the adjacent display frames, energy consumption is made to be low, meanwhile the detection time is also sufficient, and detection can be performed immediately, subsequent compensation effect is good, and evenness of the panel is improved.

The control module controls the display device to enter the energy saving mode according to the obtained control parameters, wherein there are many methods to obtain the control parameters.

In an embodiment, the control module is used for controlling the display device to enter the energy saving mode according to obtained data of a current displayed image being in a static state or characters. When the current displayed image is a dynamic image, a requirement for resolution rate is high. When the current displayed image is in the static state or characters, a requirement for resolution rate is low. Therefore, the control modules can actively determine whether the display device enters the energy saving mode by judging whether the current displayed image is in a static state or characters, and wherein the static state is that each of the display frames in display frames of a preset number are in same states.

In an embodiment, the control module is used for controlling the display device to enter the energy saving mode according to an instruction for entering the energy saving mode obtained from external input. In some usage scenarios, users of the display device will put forward a requirement of low resolution display. At this time, the instruction for entering the energy saving mode will be input externally, and the control module can control the display device to enter the energy saving mode after receiving the instruction passively.

Figure 6:
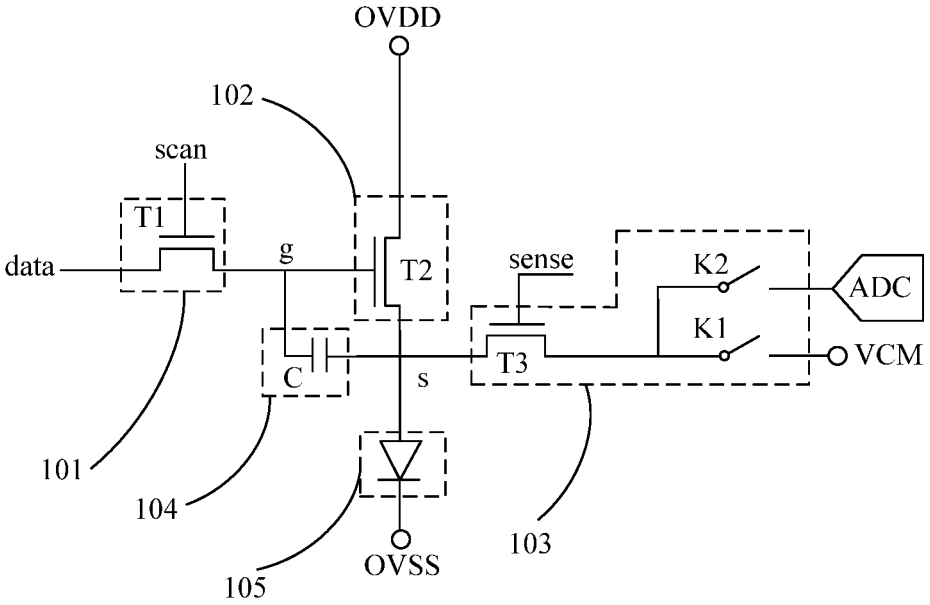
FIG. 6 is a structural schematic diagram of pixel driving circuits in the display device provided by an embodiment of the present disclosure.

As illustrated in FIG. 6, the pixel driving circuits include a data signal input unit 101, the driving unit 102, a detection unit 103, and a storage unit 104. The data signal input unit 101 is used for inputting a first data signal to a first node g under control of a first control signal. The driving unit 102 is used for driving a light emitting device 105 corresponding to the subpixels to emit light under electric potential control of the first node g. The detection unit 103 is connected to the driving unit 102 through a second node s and is used for detecting a threshold voltage of the driving unit 102 under control of a second control signal. The storage unit 104 is connected to the driving unit 102 through the first node g and the second node s and is used for storing the threshold voltage Vth of the driving unit 102. The data signal input unit 101 is further used for inputting a compensated second data signal to the first node g according to the threshold voltage Vth detected by the detection unit 103.

Specifically, the data signal input unit 101 includes a first transistor T1. A gate electrode the first transistor T1 is input the first control signal, a first electrode of the first transistor T1 is connected to a data line data, and a second electrode of the first transistor T1 is connected to the first node g. Furthermore, the first control signal is provided by a scanning line scan.

The driving unit 102 includes a second transistor T2. A gate electrode of the second transistor T2 is connected to the first node g, a first electrode of the second electrode T2 is input a power source high electric potential signal OVDD, and a second electrode of the second transistor is connected to the light emitting device 105 through the second node s.

The detection unit 103 includes a third transistor T3, a first switch K1, and a second switch K2. A gate electrode of the third transistor T3 is input the second control signal, a first electrode of the third transistor T3 is connected to the second node s, a second electrode of the third transistor T3 is connected to a first moving contact of the first switch K1 and a second moving contact of the second switch K2. A first static contact of the first switch K1 is connected to an initial voltage signal input terminal, and a second static contact of the second switch K2 is connected to an analog-to-digital converter ADC. Furthermore, the second control signal is provided by a sensing line sense.

The storage unit 104 includes a storage capacitor C. A first polar plate of the storage capacitor C is connected to the first node g, and a second polar plate of the storage capacitor C is connected to the second node s.

An anode of the light emitting device 105 is connected to the second node s, and a cathode of the light emitting device 105 is input a power source low electric potential signal OVSS. In the display device, each of the subpixels corresponds to one light emitting device 105, and the light emitting device 105 is micro light emitting diodes (micro LEDs).

In the first electrode and the second electrode of each of the transistors in the present disclosure, one is a source electrode, and the other is a drain electrode. A voltage value of the power source high electric potential signal VDD is greater than a voltage value of the power source low electric potential signal VSS, and a data line data is used for inputting a data signal Vdata. In the driving unit 102, the second transistor T2 is a driving transistor, and the threshold voltage of the driving unit 102 is the threshold voltage Vth of the second transistor T2. Each of the transistors can be an N-type or a P-type transistor. The N-type transistor is used to explain working principles of the pixel driving circuits in each of stages in the present disclosure.

Figure 7:
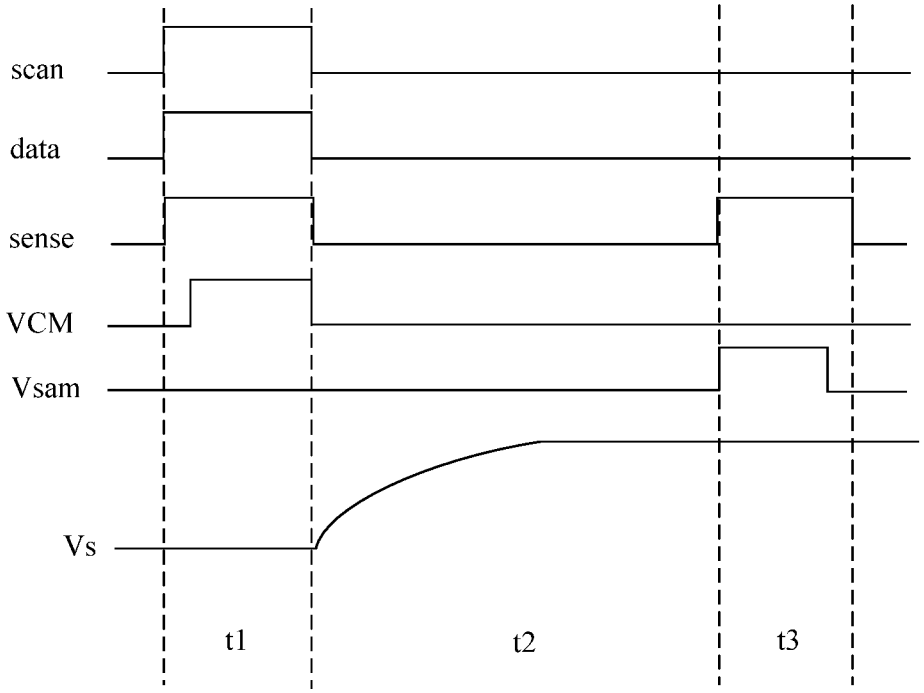
FIG. 7 is a sequence diagram of each signal of the pixel driving circuit used for detecting the threshold voltage of the driving unit in an embodiment of the present disclosure during a detection time period.
Figure 8:
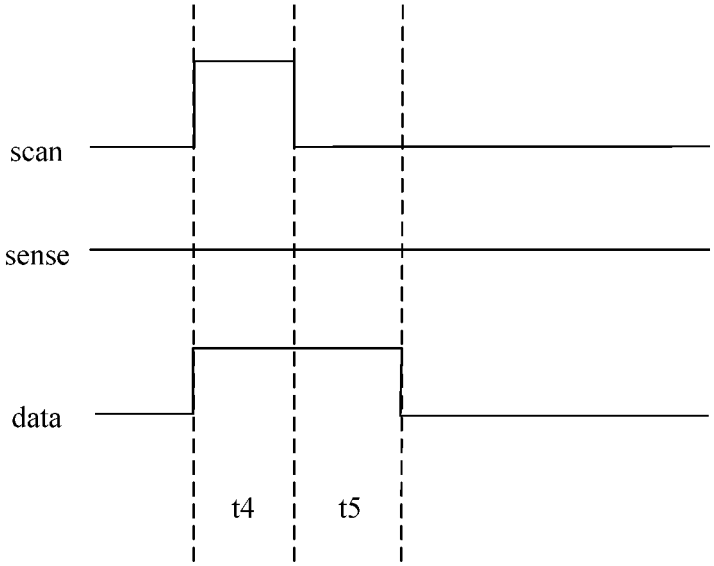
FIG. 8 is a sequence diagram of each signal of the pixel driving circuit used for driving the subpixels to emit light in an embodiment of the present disclosure during a display time period.

In a same display frame of the energy saving mode, part of the pixel driving circuits are used for driving the subpixels to emit light which is at a display time period, and another part of the pixel driving circuits are used for performing detection on the threshold voltage of the driving unit which is at a detection time period. FIG. 7 is a sequence diagram of each signal of the pixel driving circuit used for detecting the threshold voltage of the driving unit during a detection time period, and FIG. 8 is a sequence diagram of each signal of the pixel driving circuit used for driving the subpixels to emit light during a display time period. The following combines FIG. 7 and FIG. 8 to describe working principles of two parts of the pixel driving circuits in a same display frame in the energy saving mode.

As illustrated in FIG. 7, the detection time section includes an initial stage T1, a charging stage *t*2, and a voltage detection stage *t*3.

In the initial stage *t*1, the first control signal in the scanning line scan is high electric potential, and the first transistor T1 is turned on. The data line data inputs a high electric potential first data signal Vdata1 to the first node g. The second control signal in the sensing line sense is high electric potential, and the third transistor T3 is turned on. The detection unit 103 controls the first moving contact of the first switch K1 to connect to the first static contact and the second moving contact of the second switch K2 to disconnect from the second static contact, and the initial voltage signal input terminal input the initial voltage VCM to the second nodes. At this time, a gate electrode voltage of the second transistor T2 is Vdata1, and a voltage of the second electrode of the second transistor T2 is VCM.

In the charging stage *t*2, the first control signal is low electric potential, and the first transistor T1 is turned off. The second control signal is low electric potential, and the third transistor T3 is turned off. The detection unit 103 controls the first moving contact of the first switch K1 to disconnect from the first static contact and controls the second moving contact of the second switch K2 to disconnect from the second static contact in this stage. At this time, a voltage of the second node s increases continuously until Vs=Vdata1-Vth.

In the voltage detection stage *t*3, the first control signal maintains the low electric potential, and the first transistor is turned off. The second control signal maintains the high electric potential, and the third transistor T3 is turned on. The voltage of the second node s is held in a stable state equal to Vdata1-Vth. The detection unit 103 controls the first moving contact of the first switch K1 to disconnect from the first static contact and controls the second moving contact of the second switch K2 to connect to the second static contact in this stage. The analog-to-digital converter ADC detects the voltage of the second node s to generate corresponding data and then latch them, wherein the detected voltage value is indicated by Vsam, and Vsam=Vdata1-Vth.

After the detection is completed, because the first data signal Vdata1 is a known value, the threshold voltage Vth can be obtained by using a known Vdata1 to minus the detected data Vdata1-Vth. The obtained threshold voltage Vth is stored in a storage unit 104. Afterwards, in a next display frame, when the pixel driving circuits enter the display time period, adjusting the input data signal to obtain the second data signal Vdata1 to realize the threshold voltage compensation of the driving unit 102.

As illustrated in FIG. 8, the display time period includes a data writing stage *t*4 and a light emitting stage *t*5.

In the data writing stage *t*4, the first control signal in the scanning line scan is high electric potential, the first transistor T1 is turned on. The data line data inputs a high electric potential second data signal Vdata2 to the first node g. The second control signal in the sensing line sense is low electric potential. The third transistor T3 is turned off. At this time, the electric potential Vg of the first node g is Vg=Vdata2.

In the light emitting stage *t*5, the first control signal is low electric potential, and the first transistor T1 is turned off. The second control signal is maintained at low electric potential, and the third transistor T3 is turned off. Due to the maintenance effect of the storage capacitor C, the electric potential of the first node g is still Vg=Vdata2, and the voltage difference Vgs between the first node g and the second node s is greater than Vth to drive the light emitting device 105 to emit light.

From the analysis above, it can be understood that in a same display frame, working processes of the pixel driving circuits used for driving the subpixels to emit light and the pixel driving circuits used for detecting the threshold voltage of the driving unit are independent to each other. The control module controls the first pixel driving circuits to drive the subpixels in the first pixel units 11 to emit light in the odd display frames by the first driving unit, detects a first threshold voltage of the first driving unit in even display frames, performs data compensation on the first driving unit according to the detected first threshold voltage in a next odd display frame, meanwhile, controls the second pixel driving circuit to drive the subpixels in the second pixel units 12 to emit light in the even display frames by the second driving unit, detects a second threshold voltage of the second driving unit in the odd display frames, and performs data compensation on the second driving unit according to the detected second threshold voltage in a next even display frame. The first pixel driving circuits and the second pixel driving circuits work alternately to make the first pixel units 11 and the second pixel units 12 alternately emit light and alternately detect and compensate the threshold voltage. By this method, the detection time is relatively long, so that energy consumption is made to be low, and meanwhile the detection time is also sufficient, and detection can be performed immediately, subsequent compensation effect is good, and evenness of the panel is improved.

Figure 9:
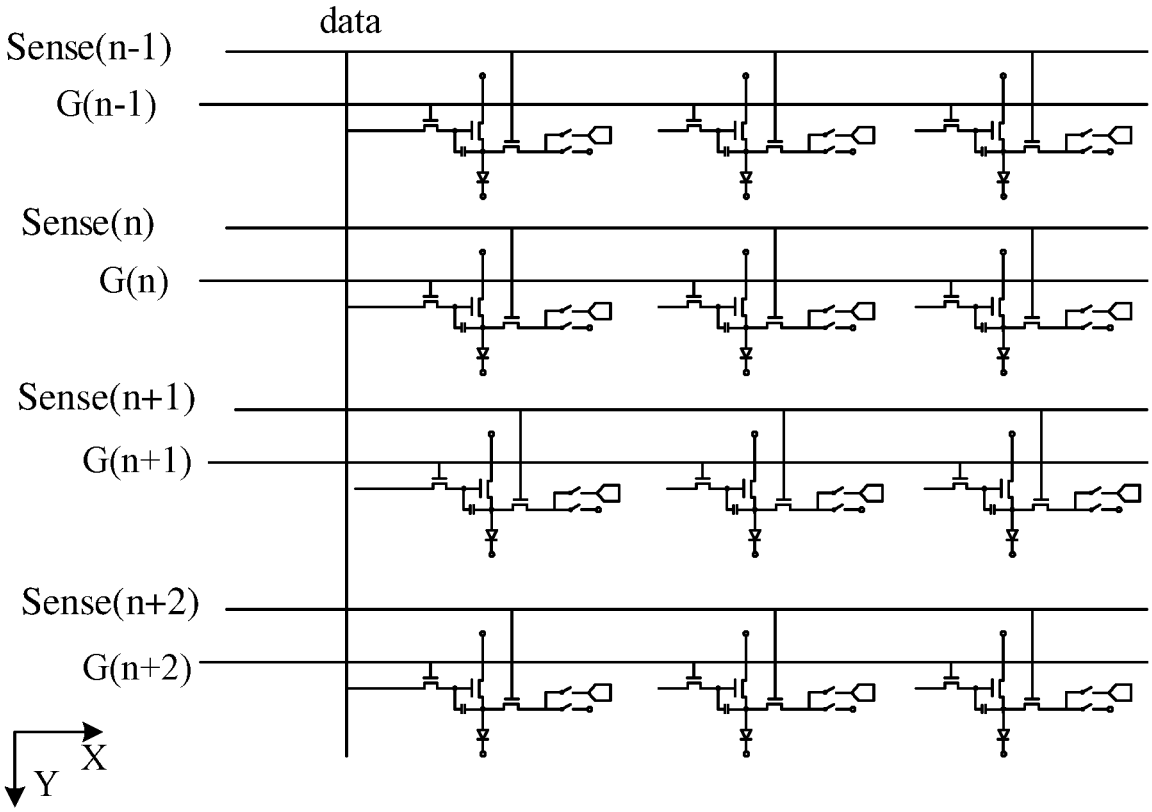
FIG. 9 is a connection schematic diagram of the pixel driving circuit and each signal line in the display device provided by an embodiment of the present disclosure.

As illustrated in FIG. 9, in each row of the subpixels of the display device, data signal input units 101 in the pixel driving circuits of each of the subpixels are connected to a same scanning line scan. The detection units 103 are connected to a same sensing line sense. Furthermore, G(n-1), G(n),G(n+1), G(n+1) are respectively the first control signals input by an n-1 th scanning line, an nth scanning line, an n+1th scanning line, and an n+2th scanning line, and Sense(n-1), Sense(n), Sense(n+1), and Sense(n+2) are respectively the second control signals input by an n-1 th sensing line, an nth sensing line, an n+1 th sensing line, and an n+2th sensing line. In addition, each row of the pixels includes three rows of the subpixels. In the three rows of the subpixels, the data signal input units in the pixel driving circuits of each of the subpixels are connected to a same data line data.

In the energy saving mode, take the odd display frames as an example, each odd-row scanning line scan inputs a high electric potential first control signal to each of the first pixel driving circuits row by row along the first direction Y to turn on the first transistors T1 in each of the first pixel driving circuits row by row, and each of the data lines data inputs the second data signal Vdata2 to a gate electrode of each of the second transistors T2 column by column along the second direction X perpendicular to the first direction Y. Each even-row scanning line scan inputs the high electric potential first control signal to each of the second pixel driving circuits row by row along the first direction Y to turn on the first transistors T1 in each of the second pixel driving circuits row by row. Each of the data lines data inputs the first data signal Vdata1 to a gate electrode of each of the second transistors T2 along the second direction X perpendicular to the first direction Y. While at the time writing the first data signal Vdata1, each even-row sensing line sense inputs the high electric potential second control signal to each of the second pixel driving circuits row by row along the first direction Y to turn on the third transistor T3 in each of the second pixel driving circuits row by row and to input the initial voltage VCM to the second electrode of the second transistor T2 in each of the second pixel driving circuits row by row.

Because in a current display frame, part of the subpixels emit light, and another part of the subpixels do not emit light, in order to prevent the two parts of the subpixels from disturbing each other, it is necessary to ensure that a time of the pixel driving circuits for detecting the threshold voltage writing the first data signal Vdata1 does not overlap with a time of the pixel driving circuits required to drive the subpixels to emit light writing the second data signal Vdata2.

In an embodiment, in a same display frame of the energy saving mode, the control module is used for controlling the pixel driving circuits required to detect the threshold voltage to be inputted the first data signal Vdata1 in a same time and to control the pixel driving circuits required to drive the subpixels to emit light to be inputted the second data signal Vdata2 row by row along the first direction Y, and the time of inputting the first data signal Vdata1 does not overlap with the time of inputting the second data signal Vdata2.

Figure 10:
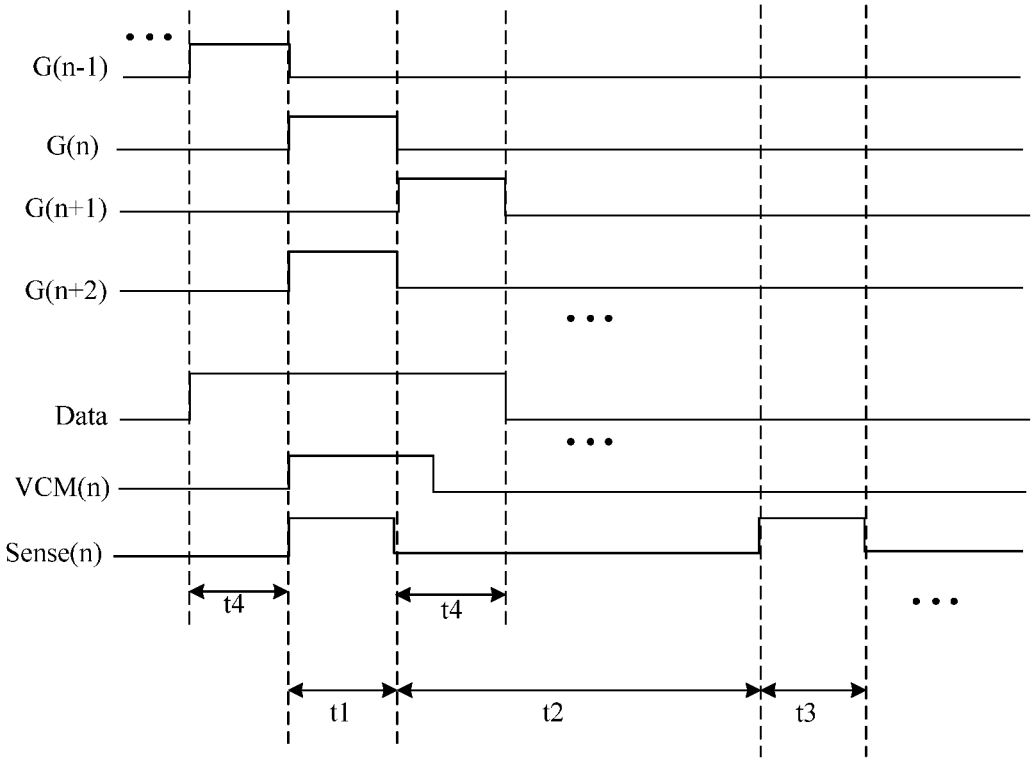
FIG. 10 is a first sequence diagram of each signal in the pixel driving circuit corresponding to each row of the subpixels in odd display frames in the display device provided by an embodiment of the present disclosure.

Illustrated in FIG. 10 is a first sequence diagram of each signal in the pixel driving circuit corresponding to each row of the subpixels in odd display frames in the display device. The n-1 th row, the n+1 th row, the n+3th row, etc. are taken to act as odd-row subpixels to form the first pixel units 11, and the n-2th row, the nth row, the n+2th row, etc. are taken to act as even rows to form the second pixel units 12, then, in the display frame, the first pixel driving circuits need to drive the subpixels to emit light, and the second pixel driving circuits need to detect the threshold voltage of the driving units. Therefore, in a first data writing stage *t*4, the control module controls the n-1th row of the first pixel driving circuits to be written in the second data signal Vdata2. In a second data writing stage *t*4, the control module controls the nth of the first pixel driving circuits to be written in the second data signal Vdata2, and so forth. The control module controls to write the second data signal Vdata2 row by row along the first direction Y until the last row of the first pixel driving circuits been written in the second data signal Vdata2.

Because there is a row between the n-1th row and the nth row, when inputting the second data signal Vdata2, the time of writing the second data signal Vdata2 in the nth row always falls behind the time of writing the second data signal Vata2 in the n-1 th row, and there is a certain interval time between the two writing times. Therefore, the control module can control all second pixel driving circuits to simultaneously write the first data signal Vdata1 in the interval time, that is, the interval time is made to act as an initial stage *t*1 of the second pixel driving circuits. By this method, the time of the second data signal Vdata2 written in the first pixel driving circuits and the time of the first data signal Vdata2 written in the second pixel driving circuits are staggered to allow the subpixels emitting light and the subpixels not emitting light to not disturb each other.

When the pixel driving circuits are in the detection time period, the voltage of the second node s needs to gradually raise to Vs=Vdata1-Vth in the charging stage *t*2 of the detection time period, and the charging stage uses the longest duration. Moreover, only when entering the voltage detection stage *t*3 after the Vs is stable is the value of the measured threshold voltage Vth accurate. In order to ensure there is enough time for the voltage of the second node s to raise to be stable, it is necessary to write the first data signal Vdata1 to the second pixel driving circuits in the current display frame as soon as possible. After passing through a preset long time, the voltage detection stage *t*3 is then entered, and at this time, a detection structure of the threshold voltage is relatively accurate. Therefore, in an interval period between two arbitrary data writing stages *t*4 of the first pixel driving circuits, the first data signal Vdata1 can be simultaneously written in all second pixel driving circuits. However, the time of writing the first data signal Vdata1 is as close to forward as possible in a current frame, and after a preset duration, all second pixel driving circuits enter the voltage detection stage *t*3, and then the second threshold voltage of the second driving units in each of the second pixel driving circuits can be collected sequentially.

In an embodiment, in a same display frame of the energy saving mode, the control module is used for controlling the pixel driving circuit required to detect a threshold voltage to input the first data signal row by row along the first direction and is used for controlling the pixel driving circuit required to drive the subpixels to emit light to be inputted the second data signal row by row along the first direction, and the time of inputting the first data signal does not overlap with the time of inputting the second data signal.

Figure 11:
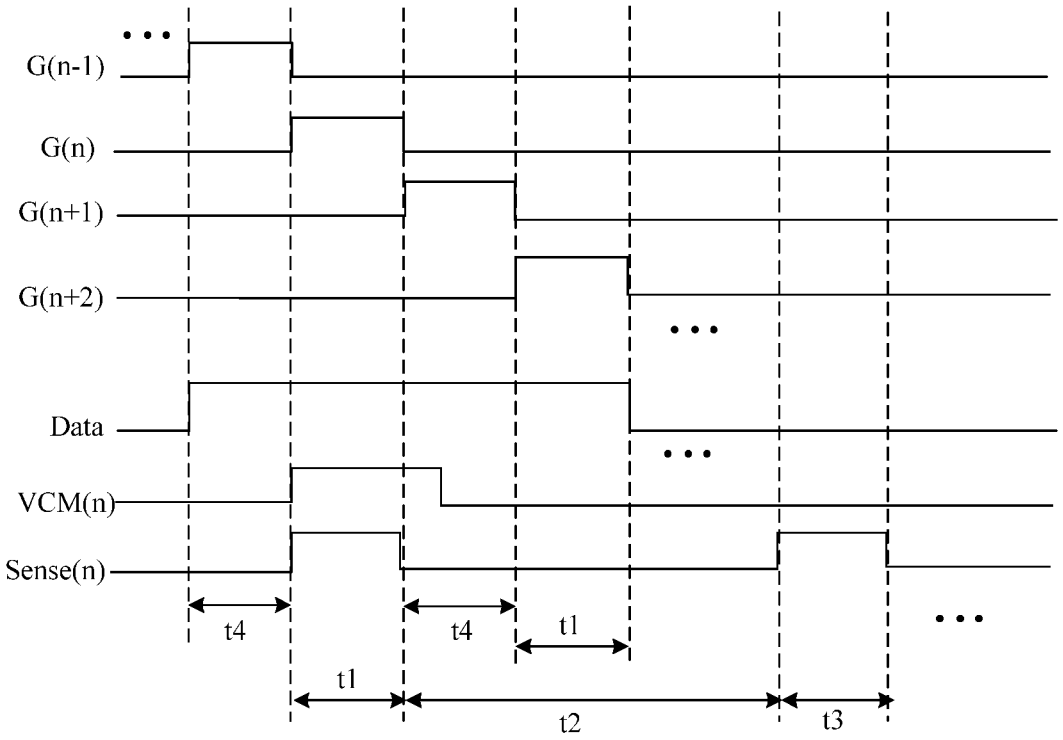
FIG. 11 is a second sequence diagram of each signal in the pixel driving circuit corresponding to each row of the subpixels in odd display frames in the display device provided by an embodiment of the present disclosure.

Illustrated in FIG. 11 is a second sequence diagram of each signal in the pixel driving circuit corresponding to each row of the subpixels in odd display frames in the display device. The difference between FIG. 10 is that the second pixel driving circuits in this embodiment is written in the first data signal Vdata1 row by row along the first direction Y. Because the first pixel driving circuits and the second pixel driving circuits are written in the data signals row by row along the first direction Y, and the time of the data writing stage *t*4 of the first pixel driving circuits does not overlap with the time of the initial stage *t*1 of the second pixel driving circuits. Therefore, the initial stages *t*1 of the second pixel driving circuits corresponding to each row of the subpixels are at the interval time periods of the data writing stages *t*4 of the first pixel driving circuits corresponding to up and down two adjacent rows of subpixels. At this time, in the whole display device, all scanning lines scan can scan row by row from the first row to the last row of the first direction Y according to a general scanning method to sequentially input the second data signal Vdata2 to the first pixel driving circuits corresponding to the odd-row subpixels and sequentially input the first data signal Vdata1 to second first pixel driving circuits corresponding to the even-row subpixels. By using this method, current time sequences of each of the signals are changed less, so it is easier to implement.

In the embodiments mentioned above, the odd display frames are taken as the examples for description, and in the even display frames, it only needs to exchange the working states of the first pixel driving circuits and the second pixel driving circuits, and working principles of each of the pixel driving circuits are same as those in the odd display frames, and redundant description will not be mentioned herein. In addition, the times of writing data signals to each of the pixel driving circuits are not limited to the embodiments corresponding to FIG. 10 and FIG. 11, and other solutions for making the time of the first pixel driving circuits written the second data signals Vdata2 and the time of the second pixel driving circuits written the first data signal Vdata be staggered fall into the scope of protection of the present disclosure.

In an embodiment, when the display device does not enter the energy saving mode, the control module is further used for controlling all the pixel driving circuits to drive corresponding subpixels to emit light in display frames and to detect threshold voltages of the driving units in a blank time between adjacent display frames. When not entering the energy saving mode, the control module controls the pixel driving circuit to detect the threshold voltage of the driving units at the blank time between the adjacent display frames according to a standard method, and then to perform data compensation according to the threshold voltage and input a compensated data signal in a next display frame to drive corresponding subpixels to emit light. By this method, in two states of entering the energy saving mode and not entering the energy saving mode, detection and the compensation are performed on the threshold voltage, and detection accuracy of the energy saving mode is high. Therefore, the whole threshold voltage compensation effect to the display device obtains improvement, and evenness of the panel is also improved.

The present disclosure further provides a terminal including a display device and a housing, and the display device is the display device mentioned in any embodiment above. The terminal of the present disclosure can simultaneously realize reduction of energy consumption and improvement of accuracy of threshold voltage compensation, and evenness of the panel is good.

According to embodiments mentioned above, it can be understood that:

the embodiments of the present disclosure provide a display device and a terminal; the display device includes a plurality of subpixels, a plurality of pixel driving circuits, and a control module; the plurality of subpixels are disposed in an array arrangement in the display device to form a plurality of pixel units. The plurality of pixel units include a plurality of first pixel units and a plurality of second pixel units arranged alternately along a first direction. The plurality of first pixel units and the plurality of second pixel units include at least one row of the plurality of subpixels; the pixel driving circuit is used for driving the plurality of subpixels to emit light by a plurality of driving units, and the plurality of pixel driving circuits include a first pixel driving circuit driving the plurality of subpixels in the plurality of first pixel units to emit light by a first driving unit, and a second pixel driving circuit driving the plurality of subpixels in the plurality of second pixel units to emit light by a second driving unit;

the control module is used for controlling the display device to enter an energy saving mode according to obtained control parameters, in the energy saving mode, the control module is used for controlling the first pixel driving circuit to drive the plurality of subpixels in the plurality of first pixel units to emit light in odd display frames by the first driving unit, for detecting a first threshold voltage of the first driving unit in even display frames, for performing data compensation on the first driving unit according to the detected first threshold voltage in a next odd display frame, for controlling the second pixel driving circuit to drive the plurality of subpixels in the plurality of second pixel units to emit light in the even display frames by the second driving unit, for detecting a second threshold voltage of the second driving unit in the odd display frames, and for performing data compensation on the second driving unit according to the detected second threshold voltage in a next even display frame.

The display device of the present disclosure enters the energy saving mode under a certain condition, controls part of the subpixels to emit light in the energy saving mode and controls another part of the subpixels to perform threshold voltage detection corresponding the pixel driving circuit. Because duration of a display frames is greater than a blank time period between the adjacent display frames, energy consumption is made to be low, meanwhile the detection time is also sufficient, and detection can be performed immediately, subsequent compensation effect is good, and evenness of the panel is improved.

In the above embodiments, the description of each embodiment has its emphasis, and for some embodiments that may not be detailed, reference may be made to the relevant description of other embodiments.

The embodiments of present disclosure are described in detail above. This article uses specific cases for describing the principles and the embodiments of the present disclosure, and the description of the embodiments mentioned above is only for helping to understand the method and the core idea of the present disclosure. It should be understood by those skilled in the art, that it can perform changes in the technical solution of the embodiments mentioned above, or can perform equivalent replacements in part of technical characteristics, and the changes or replacements do not make the essence of the corresponding technical solution depart from the scope of the technical solution of each embodiment of the present disclosure.

The invention claimed is:

1. A display device, comprising:

a plurality of subpixels, wherein the plurality of subpixels are disposed in an array arrangement in the display device to form a plurality of pixel units, the plurality of pixel units comprise a plurality of first pixel units and a plurality of second pixel units arranged alternately along a first direction, and the plurality of first pixel units and the plurality of second pixel units comprise at least one row of the plurality of subpixels;

a plurality of pixel driving circuits used for driving the plurality of subpixels to emit light by a plurality of driving units, wherein the plurality of pixel driving circuits comprise a first pixel driving circuit driving the plurality of subpixels in the plurality of first pixel units to emit light by a first driving unit, and a second pixel driving circuit driving the plurality of subpixels in the plurality of second pixel units to emit light by a second driving unit; and a driving integrated circuit used for controlling the display device to enter an energy saving mode according to obtained control parameters, wherein in the energy saving mode, the driving integrated circuit is used for controlling the first pixel driving circuit to drive the plurality of subpixels in the plurality of first pixel units to emit light in odd display frames by the first driving unit, for detecting a first threshold voltage of the first driving unit in even display frames, for performing data compensation on the first driving unit according to the detected first threshold voltage in a next odd display frame, for controlling the second pixel driving circuit to drive the plurality of subpixels in the plurality of second pixel units to emit light in the even display frames by the second driving unit, for detecting a second threshold voltage of the second driving unit in the odd display frames, and for performing data compensation on the second driving unit according to the detected second threshold voltage in a next even display frame.

2. The display device as claimed in claim 1, wherein the driving integrated circuit is used for controlling the display device to enter the energy saving mode according to obtained data of a current displayed image being in a static state or characters.

3. The display device as claimed in claim 1, wherein the driving integrated circuit is used for controlling the display device to enter the energy saving mode according to an instruction for entering the energy saving mode obtained from external input.

4. The display device as claimed in claim 1, wherein the plurality of pixel driving circuits comprise a data signal input unit, the driving units, a detection unit, and a storage unit, wherein the data signal input unit is used for inputting a first data signal to a first node under control of a first control signal during a detection time period, the driving units are used for driving a light emitting device corresponding to the plurality of subpixels to emit light under electric potential control of the first node during a display time period, the detection unit is connected to the driving units through a second node and is used for detecting a threshold voltage of the driving units under control of a second control signal during the detection time period, the storage unit is connected to the driving units through the first node and the second node and is used for storing the threshold voltage of the driving units, and the data signal input unit is used for inputting a compensated second data signal to the first node according to the threshold voltage detected by the detection unit during a next display time period.

5. The display device as claimed in claim 4, wherein the data signal input unit comprises a first transistor, wherein a gate electrode the first transistor is input the first control signal, a first electrode of the first transistor is connected to a data line, and a second electrode of the first transistor is connected to the first node.

6. The display device as claimed in claim 5, wherein the driving units comprise a second transistor, wherein a gate electrode of the second transistor is connected to the first node, a first electrode of the second electrode is input a power source high electric potential signal, and a second electrode of the second transistor is connected to the light emitting device through the second node.

7. The display device as claimed in claim 6, wherein the detection unit comprises a third transistor, a first switch, and a second switch, wherein a gate electrode of the third transistor is input the second control signal, a first electrode of the third transistor is connected to the second node, a second electrode of the third transistor is connected to a first moving contact of the first switch and a second moving contact of the second switch, a first static contact of the first switch is connected to an initial voltage signal input terminal, and a second static contact of the second switch is connected to an analog-to-digital converter.

8. The display device as claimed in claim 7, wherein the storage unit comprises a storage capacitor, wherein a first polar plate of the storage capacitor is connected to the first node, and a second polar plate of the storage capacitor is connected to the second node.

9. The display device as claimed in claim 8, wherein an anode of the light emitting device is connected to the second node, and a cathode of the light emitting device is input a power source low electric potential signal.

10. The display device as claimed in claim 9, wherein the light emitting device is micro light emitting diodes.

11. The display device as claimed in claim 10, wherein in the energy saving mode, during an initial stage of the detection time period, the detection unit is used for controlling the first moving contact to connect to the first static contact and for controlling the second moving contact to disconnect from the second static contact, during a charging stage of the detection time period, the detection unit is used for controlling the first moving contact and the first static contact, and for controlling the second moving contact and the second static contact to disconnect from each other, and during a voltage detection stage of the detection time period, the detection unit is used for controlling the first moving contact to disconnect from the first static contact and for controlling the second moving contact to connect to the second static contact.

12. The display device as claimed in claim 11, wherein in a same display frame of the energy saving mode, the driving integrated circuit is used for controlling the plurality of pixel driving circuits required to detect a threshold voltage to be inputted the first data signal in a same time and is used for controlling the plurality of pixel driving circuits required to drive the plurality of subpixels to emit light to be inputted the second data signal row by row along the first direction, wherein a time of inputting the first data signal does not overlap with a time of inputting the second data signal.

13. The display device as claimed in claim 11, wherein in a same display frame of the energy saving mode, the driving integrated circuit is used for controlling the pixel driving circuits required to detect a threshold voltage to be inputted the first data signal row by row along the first direction and is used for controlling the pixel driving circuits required to drive the plurality of subpixels to emit light to be inputted the second data signal row by row along the first direction, wherein a time of inputting the first data signal does not overlap with a time of inputting the second data signal.

14. The display device as claimed in claim 1, wherein when the display device does not enter the energy saving mode, the driving integrated circuit is used for controlling all the pixel driving circuits to drive corresponding subpixels to emit light in display frames and for detecting threshold voltages of the plurality of driving units in a blank time between adjacent display frames.

15. A terminal, comprising a display device and a housing, wherein the display device comprises:

a plurality of subpixels, wherein the plurality of subpixels are disposed in an array arrangement in the display device to form a plurality of pixel units, the plurality of pixel units comprise a plurality of first pixel units and a plurality of second pixel units arranged alternately along a first direction, and the plurality of first pixel units and the plurality of second pixel units comprise at least one row of the plurality of subpixels;

a plurality of pixel driving circuits used for driving the plurality of subpixels to emit light by a plurality of driving units, wherein the plurality of pixel driving circuits comprise a first pixel driving circuit driving the plurality of subpixels in the plurality of first pixel units to emit light by a first driving unit, and a second pixel driving circuit driving the plurality of subpixels in the plurality of second pixel units to emit light by a second driving unit; and a driving integrated circuit used for controlling the display device to enter an energy saving mode according to obtained control parameters, wherein in the energy saving mode, the driving integrated circuit is used for controlling the first pixel driving circuit to drive the plurality of subpixels in the plurality of first pixel units to emit light in odd display frames by the first driving unit, for detecting a first threshold voltage of the first driving unit in even display frames, for performing data compensation on the first driving unit according to the detected first threshold voltage in a next odd display frame, for controlling the second pixel driving circuit to drive the plurality of subpixels in the plurality of second pixel units to emit light in the even display frames by the second driving unit, for detecting a second threshold voltage of the second driving unit in the odd display frames, and for performing data compensation on the second driving unit according to the detected second threshold voltage in a next even display frame.

16. The terminal as claimed in claim 15, wherein the driving integrated circuit is used for controlling the display device to enter the energy saving mode according to obtained data of a current displayed image being in a static state or characters.

17. The terminal as claimed in claim 15, wherein the driving integrated circuit is used for controlling the display device to enter the energy saving mode according to an instruction for entering the energy saving mode obtained from external input.

18. The terminal as claimed in claim 15, wherein the plurality of pixel driving circuits comprise a data signal input unit, the driving units, a detection unit, and a storage unit, wherein the data signal input unit is used for inputting a first data signal to a first node under control of a first control signal during a detection time period, the driving units are used for driving a light emitting device corresponding to the plurality of subpixels to emit light under electric potential control of the first node during a display time period, the detection unit is connected to the driving units through a second node and is used for detecting a threshold voltage of the driving units under control of a second control signal during the detection time period, the storage unit is connected to the driving units through the first node and the second node and is used for storing the threshold voltage of the driving units, and the data signal input unit is used for inputting a compensated second data signal to the first node according to a threshold voltage detected by the detection unit during a next display time period.

19. The terminal as claimed in claim 18, wherein in a same display frame of the energy saving mode, the driving integrated circuit is used for controlling the plurality of pixel driving circuits required to detect a threshold voltage to be inputted the first data signal in a same time and is used for controlling the plurality of pixel driving circuits required to drive the plurality of subpixels to emit light to be inputted the second data signal row by row along the first direction, wherein a time of inputting the first data signal does not overlap with a time of inputting the second data signal.

20. The terminal as claimed in claim 18, wherein in a same display frame of the energy saving mode, the driving integrated circuit is used for controlling the pixel driving circuits required to detect a threshold voltage to be inputted the first data signal row by row along the first direction and is used for controlling the pixel driving circuit required to drive the plurality of subpixels to emit light to be inputted the second data signal row by row along the first direction, wherein a time of inputting the first data signal does not overlap a time of inputting the second data signal.

* * * * *